United States Patent [19]

Hofman

[11] Patent Number: 5,029,406

[45] Date of Patent: Jul. 9, 1991

[54] SIGN STRUCTURES

[75] Inventor: James A. Hofman, Lake Bluff, Ill.

[73] Assignee: Eldon Industries, Inglewood, Calif.

[21] Appl. No.: 523,392

[22] Filed: May 15, 1990

[51] Int. Cl.[5] ..... G09F 7/08

[52] U.S. Cl. ..... 40/488; 40/597; 40/622

[58] Field of Search ..... 40/488, 490, 584, 597, 40/585, 618, 620, 622, 154

[56] References Cited

U.S. PATENT DOCUMENTS

| | | | |
|---|---|---|---|
| 503,389 | 8/1893 | Sheppman | 40/488 X |
| 567,012 | 9/1896 | Strong | 40/488 |
| 2,880,537 | 10/1956 | Cygan | 40/620 |
| 3,914,890 | 10/1975 | Behlen, Jr. | 40/597 |
| 4,035,940 | 7/1977 | Mickey et al. | 40/590 X |
| 4,171,584 | 10/1979 | Kaiser | 40/490 |

*Primary Examiner*—Kenneth J. Dorner
*Assistant Examiner*—J. Bonifanti
*Attorney, Agent, or Firm*—Joseph C. Andras

[57] ABSTRACT

A desirable sign structure can be formed using a hollow, integral, self-supporting thermoplastic polymer body shaped so as to include a hollow border or peripheral frame carrying front and back walls of the sign structure. Grooves adapted to carry extensions on interchangeable letters may be provided in the front wall. When such grooves are used, the back wall preferably includes grooves or furrows reinforcing the front wall. A slot can be provided in the front and back walls in such a manner as to separate the front and back walls into two panels or panel sections. When such a slot is used, guides or tracks are preferably employed so as to mount a shutter in the slots, the shutter being capable of movement in order to cover or uncover one of the panels or panel sections.

7 Claims, 4 Drawing Sheets

SIGN STRUCTURES

BACKGROUND OF THE INVENTION

1. Field of the Invention

The invention set forth in this specification pertains to new and improved sign structures. More specifically, it pertains to sign structures that are especially desirable because of the fact that they can be easily and conveniently manufactured at a comparatively nominal cost.

2. Description of Related Art

The most closely related prior art sign structures commonly include a centrally located panel adapted to carry one or more indicia. The panel is usually surrounded and held by a peripheral frame. Normally such closely related sign structures are of such size as to be capable of being used in windows, building lobbies or the like. Desired indicia can be formed into or located on the panel, or the panel can hold a surface covering which, in turn, is adapted to carry one or more items to be displayed. It is frequently desired to form the panel so that it is provided with parallel grooves or channels which are adapted to support and display indicia such as letters.

The panels have been commonly formed out of sheets of a "solid" material such as plywood or particle board. The grooves are provided by first sawing parallel grooves in the solid panel and then pressing a flexible sheet of felt or the like into the grooves. In such structures, the felt or the like is used to provide a frictional connection between the sides of the grooves and extensions provided on the back of the indicia. The felt is usually adequate to prevent the indicia from moving during limited handling of a sign structure, yet allows the indicia to be replaced whenever desired. Such panels have also been formed by molding essentially solid structures out of synthetic rubber type polymer compositions.

The frames commonly used with panels are normally constructed in what can be regarded as a "traditional" manner where the frames and panels are assembled into an essentially "unitary" structure. Recently, both the frames and the panels have been constructed of comparatively thin sheets of a thermoplastic polymer material. However, both the solid-type and the sheet-type of sign construction have significant commercial drawbacks and limitations.

The signs tend to be relatively expensive to manufacture and comparatively heavy when "traditional" frames are used with either "solid" panels or sheet panels, as discussed in the preceding. Such signs are, therefore, comparatively expensive to ship. On the other hand, when sign structures are entirely formed of thin sheets of a thermoplastic material, the costs of manufacturing such sign structures tend to be significantly reduced. Also, because of the relative light weight of such sign structures, they tend to be comparatively inexpensive to ship.

However, the advantages associated with sheet-type construction are achieved at a price. It is considered that these sign structures tend to be less attractive and rigid than sign structures employing "traditional" frames and "solid" panels. In particular, the walls of such sign structures are frequently so thin that they are pierced when the rear extension of replaceable indicia are inserted in the parallel grooves. In addition, it is considered that there is a degree of danger that sign structures formed from such thin sheets may tend to warp after they are constructed, particularly when they are used in a window in a hot area where the temperature of the sign conceivably could reach the softening point of the polymer material in the sign.

The detrimental factors referred to in the preceding paragraph are easily illustrated by referring to a current commercial type of "shutter" sign manufactured from a sheet of thermoplastic material. Such sign structures are typically formed from a single sheet of thermoplastic polymer material using conventional vacuum forming techniques. They usually include a peripheral frame that is integral with first and second panels that are offset from one another and separated by a slot. Such signs typically include extruded tracks that extend along the slot between the first and second panels. A shutter is usually held by the tracks so as to be capable of being moved between a position covering the front surface of the first panel to a position exposing this front surface.

A grooved sheet capable of holding indicia is normally secured to the front surface of the first panel in such "shutter" signs. It is considered obvious that such a sheet could also be adhered to the front surface of the second panel or omitted. When no such grooved sheet is used on either of these front surfaces, such surfaces can either be formed so as to contain permanent indicia or formed flat so as to be capable of supporting a paper or the like containing the desired indicia.

Sign structures as indicated in the preceding paragraphs are utilitarian and are desirable for several reasons. One is that they weigh comparatively little and, hence, can be shipped cheaply. Another is that they are comparatively easy and inexpensive to manufacture because of the inherent character of vacuum forming.

However, it is considered that normally they do not have the desired "substantial" type appearance desired for many commercial applications because of the thin character of the sheets used in manufacturing them. In particular, because of factors related to vacuum forming, they are frequently so thin that there is a significant danger of the rear extensions of indicia puncturing them. Moreover, it is considered that they are excessively prone to warping because of the character of the thermoplastic sheets used in their construction.

SUMMARY OF THE INVENTION

It is believed that it will be apparent from the preceding that there is a need for new and improved sign structures which are related to those sign structures discussed above. Broadly, the invention is intended to provide sign structures meeting or fulfilling this need.

An object of the invention is intended to provide sign structures which are related to those previously indicated which may be easily and conveniently manufactured at a comparatively nominal cost. A further object of the invention is to provide sign structures that are relatively light in weight that, in spite of this fact, have a "solid" or "substantial" appearance. It is a further object of the invention to provide sign structures that tend to be more resistant to being punctured, or to warping, or both, than prior related signs formed out of comparatively thin sheets or members. A related objective of the invention is to provide sign structures which are desirable for the reasons indicated, yet can be manufactured in different configurations for commercial reasons.

These broad objectives of the invention are achieved by providing a sign structure having a peripheral frame and a grooved panel enclosed and carried by said frame in which the improvement comprises said sign structure having an integral, hollow, self-supporting, thermoplastic polymer body having front and back sides which are joined at their edges, said sides being shaped so as to form said frame and said panel, said panel including a grooved, generally flat portion of said front side in which the grooves are parallel, spaced grooves of such a dimension as to be capable of carrying projections from interchangeable indicia inserted in said grooves, said also including a generally flat portion of said back side, said portion of said back side engaging said portion of said front side so as to reinforce said portion of said front side against warping.

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

BRIEF DESCRIPTION OF THE DRAWINGS

Because of the nature and complexity of the invention, it is best more fully described with reference to the accompanying drawings, in which.

Figure 2:
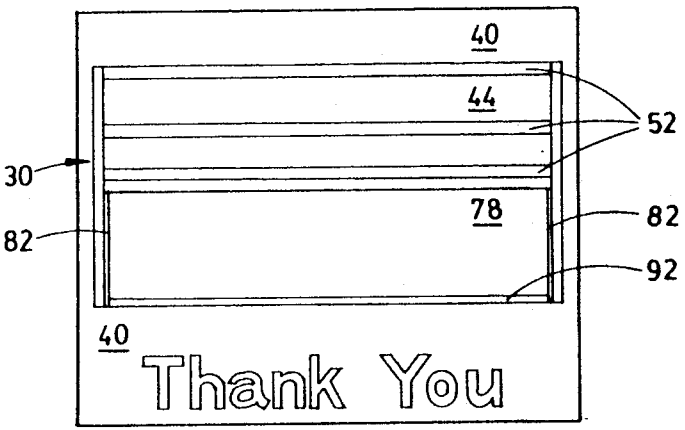
FIG. 2 is a rear view of the sign structure shown in FIG. 1 with the shutter in the position as indicated in FIG. 1.
Figure 4:
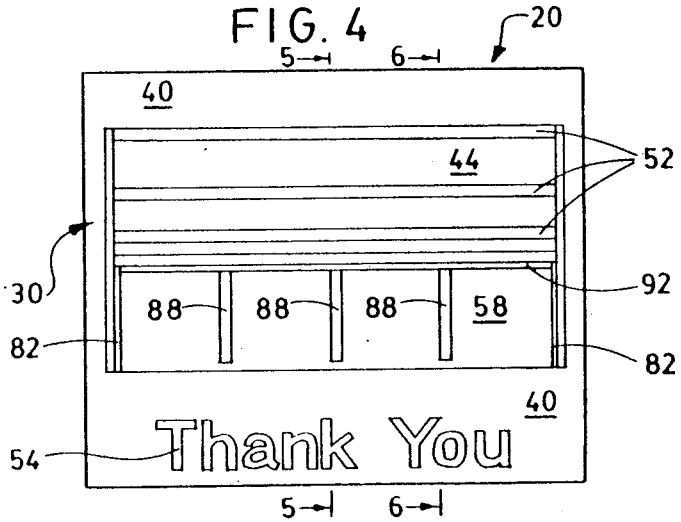
FIG. 4 is a rear view of the sign structure shown in FIG. 1 when the shutter is in the position indicated in FIG. 3.

The specific sign structures illustrated in the drawings are constructed so as to use the principles of concepts of the invention set forth and claimed in the accompanying claims. Those skilled in the field of the design of sign structures of the type to which this invention relates will realize that these concepts or principles can be used in other, differently appearing and somewhat differently constructed sign structures through the use or exercise of routine skill in this field. For this reason, the invention is not to be considered as being limited to the exact sign structures illustrated.

DESCRIPTION OF THE PREFERRED EMBODIMENTS

In the initial eight figures of the drawings, there is shown a changeable sign structure 20 having a front side 24 and a back side 26. The sign structure 20 is preferably formed in accordance with the invention by known techniques used to form hollow bodies having comparatively thick, impervious, self-supporting thermoplastic polymer exteriors of a somewhat irregular shape. The sign structure 20 is preferably sufficiently thick so that there is little danger of it being punctured or fractured during handling or use. Normally such thickness cannot be easily achieved by vacuum forming procedures.

Because the techniques that can be used to form the sign structure 20 are well known in the plastic molding industry, it is not necessary to discuss them in this specification. These techniques include rotational molding, injection-blow molding, and other related techniques. Such techniques frequently result in bodies, such as the sign structure 20, of uneven wall thickness. Normally at least parts of the exteriors of such bodies will be comparatively thin.

As formed, the sign structure 20 has a front side 24 and a back side 26 which are joined at a mold parting line 28. These sides 24 and 26 are shaped as hereinafter discussed so as to cooperate with one another in defining a hollow peripheral frame 30, a first panel 32, and a second panel 34. It will be apparent that the peripheral frame 30 and the panels 32 and 34 are of such a nature that each of them includes subsequently identified portions, areas, or sections of each of the sides 24 and 26. This is best illustrated by more specifically describing the peripheral frame 30 and the first and second panels 32 and 34.

For appearance reasons, and in order to have a desired resistance to deformation, the peripheral frame 30 is preferably shaped so as to include a border frame wall 36 which is carried by front and back frame walls 38 and 40, respectively. The mold parting line 28 extends completely around this wall 36. The front and back frame walls 38 and 40 are preferably spaced from one another in order to give the peripheral frame 30 a comparatively "massive" "solid" type of appearance. If desired, the frame walls 36, 38 and 40 can be formed so as to include surface ornamentation (not shown) or various indicia (not shown).

The first panel 32 is formed so as to include first panel front and back walls 42 and 44, respectively, forming parts of the front and back sides 24 and 26, respectively. The first panel front wall 42 is carried by inset walls 46 which extend inwardly from the front frame wall 38 so that the first panel front wall 42 is spaced away from the front frame wall 38 and generally toward the back frame wall 40. If desired, the first panel front wall 42 may include indicia such as the indicia 50 spelling the word "Open" shown in FIG. 1. The first panel back wall 44 differs from the first panel front wall 42 in that it is not inset. Instead, it appears essentially as an extension of the back frame wall 40 of the frame 30.

This first panel back wall 44 is preferably shaped so as to include a plurality of spaced channels or grooves 52. These grooves 52 are of such a dimension that their bottoms abut or are in contact with the front panel wall 42. When so formed, these grooves 52 not only serve as structural members to stiffen the first panel back wall 44, but also engage the first panel front wall 42 in such a manner as to tend to stiffen it as well. Thus, the grooves 52 can be considered as "reinforcing means" for reinforcing the first panel front wall 42. The bottoms of the grooves 52 will normally be integral with or welded to the first panel front wall 42 as a result of the manufacturing process and the amount of polymer material used. If this integration has not resulted from the manufacturing process, the bottoms of the grooves 52 can be secured to the first panel front wall 42 by ultrasonic welding or other techniques so as to improve the reinforcing action obtained.

Figure 9:
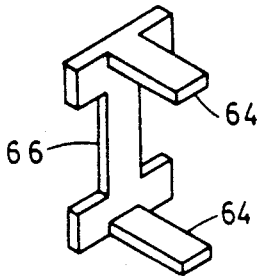
FIG. 9 is an enlarged isometric view showing the back side of a typical replaceable indicia capable of being employed with the sign structure indicated in the preceding figures.
Figure 7:
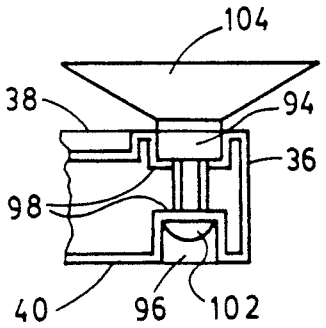
FIG. 7 is a partial cross-sectional view taken at a further enlarged scale taken at line 7—7 of FIG. 5.

The second panel 34 corresponds to a limited degree to the first panel 32 in that it also includes second panel front and back walls 56 and 58, respectively, forming parts of the front and back sides 24 and 26, respectively. The second panel front wall 56 appears more or less as an extension of the front frame wall 38. The second panel front wall 56 includes a plurality of spaced, parallel grooves or slots 60 having side walls spaced from one another so as to be capable of frictionally engaging projections 64 on a replaceable indicia 66, as shown in FIG. 9.

Such an indicia 66 can be shaped as one or more letters, one or more symbols, or the like. In order to make sure that such indicia 66 are not easily dislodged once they are mounted on the sign structure 20, it is normally preferred that the grooves 60 be coordinated with the wall thickness of the second panel front wall 56 and the resiliency of the material used so that there is a minor amount of material deformation as the indicia projections 64 are inserted into the grooves 60. With this type of construction the indicia 66 will normally be easily replaced, even though they are held reasonably firmly by the grooves 60.

A dividing wall 68 is used in the sign structure 20 so as to visually separate the panels 32 and 34. The dividing wall 68 can be considered to be part of the peripheral frame 30 because it more or less serves with the frame 30 as a common border for the first and second panels 32 and 34. As shown, the dividing wall 68 includes an inset wall 70 that extends generally toward the first panel 32. The inset wall 70 is separated from the first panel 32 by an elongated slot 74. A corresponding slot 76 is located in the back side 26 so as to separate the first panel back wall 44 from the second panel back wall 58.

These slots 74 and 76 can be formed without significant difficulty by cutting the sign structure 20 after it has been molded. The slots 74 and 76 cooperate to define a single passage (not separately numbered) for a movable shutter 78. This shutter 78 is movably mounted in side slots 80 serving as parallel tracks or "track means" so that the shutter 78 can be linearly moved between a first position in which the shutter 78 covers the first panel front wall 42 to a second position in which the first panel front wall 42 is exposed. In this second position, the shutter 78 extends through the slot 76 and generally into the slot 74. In the preferred embodiment, the side slots 80 are continuations of the slots 74 and 76.

Figure 8:
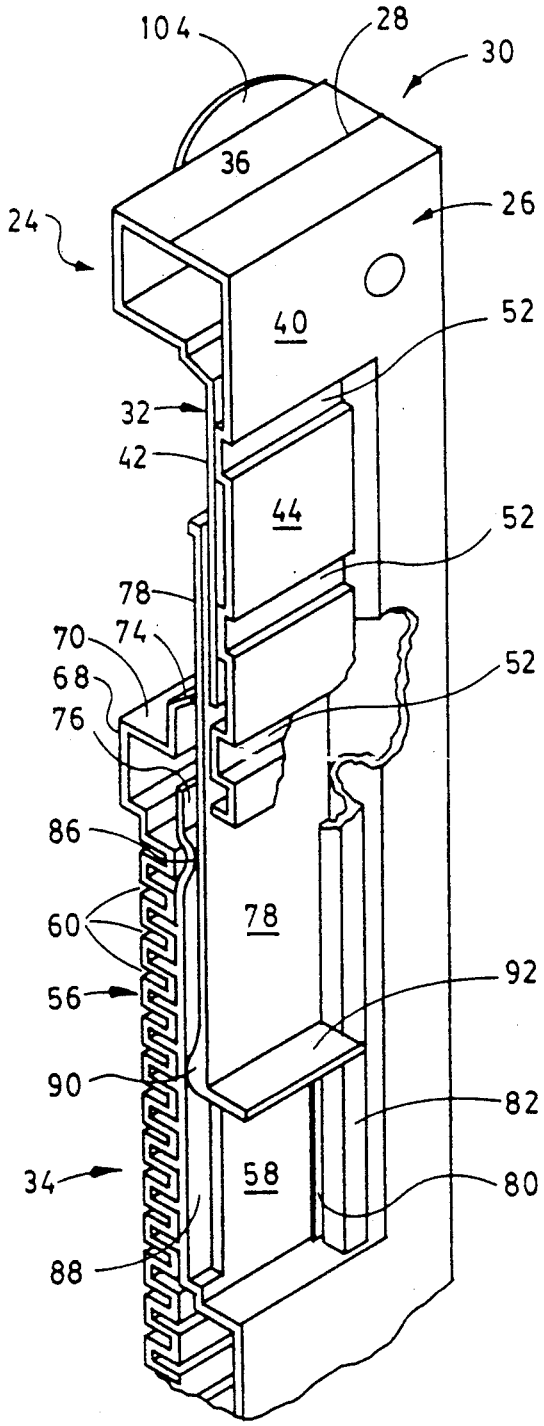
FIG. 8 is a partial isometric cutaway view of the sign structure illustrated in the preceding figures, in which the shutter is shown part way between the two positions indicated in FIGS. 1 and 3, this view being broken away at about the location of section line 6—6 in FIG. 4.

The side slots 80 are located as shown in FIG. 8 so as to extend into elongated ridges 82. The first panel front wall 42 is offset relative to and located behind the second panel back wall 58. A consequence of this construction is that the shutter 78 is hidden from view behind the second panel 34 when in its second position.

Figure 1:
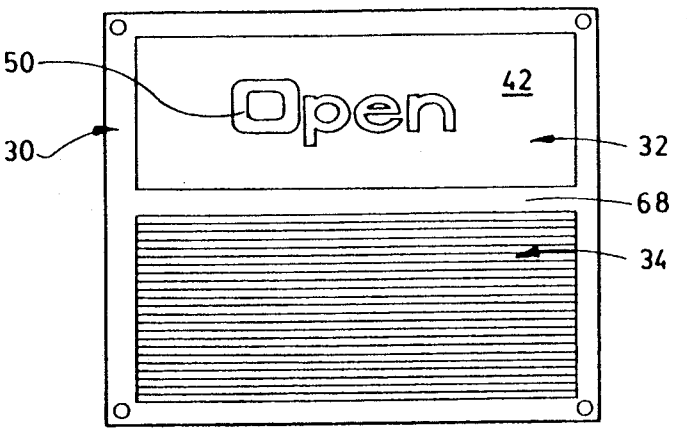
FIG. 1 is a front elevational view of a presently preferred embodiment or form of a sign structure in accordance with the invention, adjusted so that a shutter is in a first position that exposes indicia that reads "open"
Figure 3:
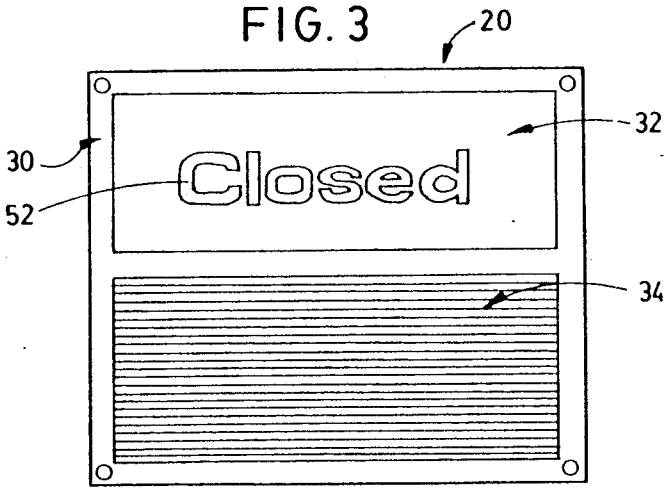
FIG. 3 is another front elevational view of the sign structure shown in FIG. 1 which differs from FIG. 1 in that the shutter is in a second position wherein the "closed" indicia on the shutter is visible.
Figure 5:
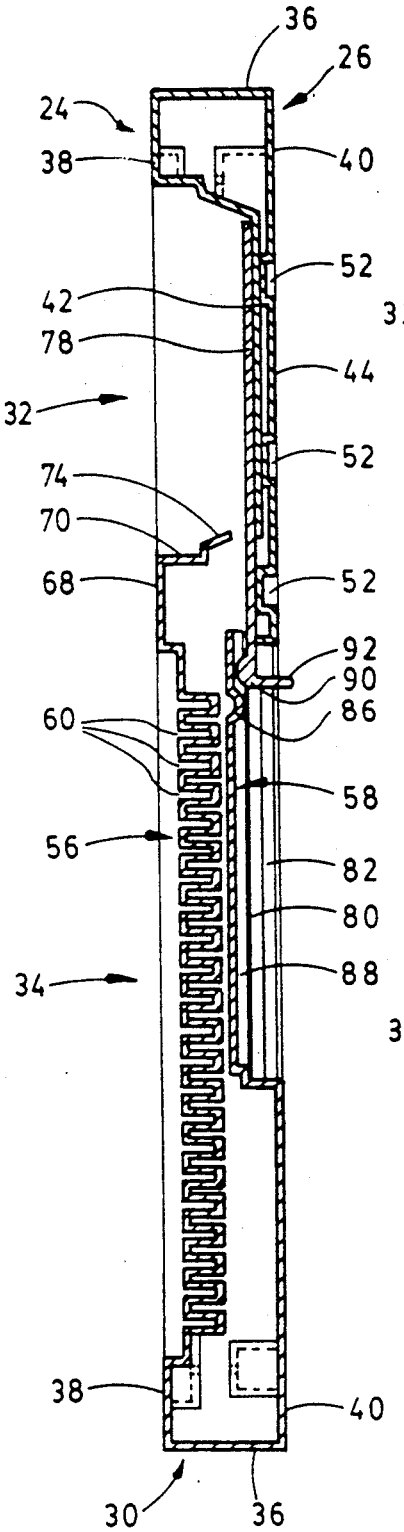
FIG. 5 is a cross-sectional view at an enlarged scale taken at line 5—5 of FIG. 4.
Figure 6:
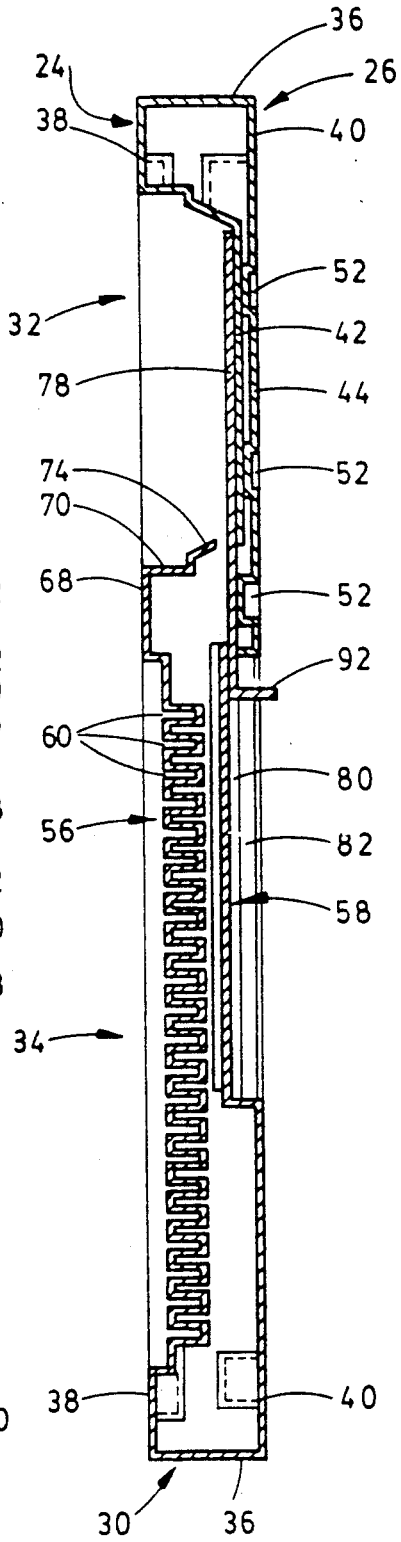
FIG. 6 is a cross-sectional view at the same scale taken at line 6—6 of FIG. 4.

It is considered obvious from a consideration of FIGS. 1 and 3 that the shutter 78 is primarily used as a means for exposing or covering the indicia 50. Thus, when the shutter 78 is in the first position, the word "Open" on the first panel front wall 42 is visible. When the shutter 78 is in the second position, the "Open" indicia 50 is covered and the shutter 78 is visible. To convey a message, the shutter 78 may contain or carry other indicia 52 spelling the word "Closed," as shown in FIG. 3.

The words "Open" and "Closed" are normally used when the sign structure 20 is used by a business establishment. Such an establishment will frequently use other indicia 66 in conjunction with the grooves 60 so as to convey other information. If desired, further indicia 54 spelling words such as "Thank You" can be contained or carried by the back frame wall 40 or any other part of the sign structure that is always visible.

After being positioned, the shutter 78 is held against undesired movement by virtue of the limited dimensions of the slots 74 and 76. The shutter 78 is also frictionally engaged between the side slots 80 and a protrusion or small curved ridge 86 on the second panel back wall 58 so that the shutter 78 will not easily slide from one position to another. In effect, this ridge 86 operates in conjunction with the side slots 80 as a "holding means" or form of a "latch means" for preventing accidental or unintentional movement of the shutter 78. Other mechanical latches or frictional holders can, of course, be substituted for the particular construction described in this paragraph in accordance with routine mechanical skill.

Vertically-extending guide grooves or furrows 88 in the second panel back wall 58 and corresponding shutter projections 90 are provided to prevent the shutter 78 from binding as it is being moved. The shutter projections 90 fit closely within the furrows 88 so as to slide along the furrows 88 as the shutter 78 is moved. The shutter 78 is preferably provided with a handle 92 for use in moving it.

The second panel back wall 58 is adjacent to the second panel front wall 56. This approximately corresponds to the manner in which the first panel front wall 42 is adjacent to the first panel back wall 44. The furrows 88 are of such a depth as to be in abutting engagement with and thereby reinforce the second panel front wall 56 against undesired deformation. It is noted that the guide furrows 88 extend generally transverse to the grooves 60 so as to effectively combat any tendency of the second panel front wall 56 to bow generally toward the second panel back wall 58. The guide furrows 88 will normally be integral with or welded to the second panel front wall 56, as a result of the manufacturing process and the amount of polymer material used. If this integration has not resulted from the manufacturing process, the furrows 88 can be secured to the second panel front wall 56 by ultrasonic welding or other techniques so as to improve the reinforcing action obtained.

Although the sign structure 20 can be supported in any convenient manner in which the front side 24 is visible, it is considered preferable to support it inside a window or the like so that both of its sides 24 and 26 are easily visible. The front and back frame walls 38 and 40 are preferably formed with axially aligned internal bores 94 and 96. The bores 94 and 96 have bottoms 98 that may either be spaced slightly (as shown) or may fit against one another. The bottoms 98 are preferably drilled so as to accommodate small screws 102 that secure conventional suction cups 104 capable of adhering to a window or the like.

Figure 10:
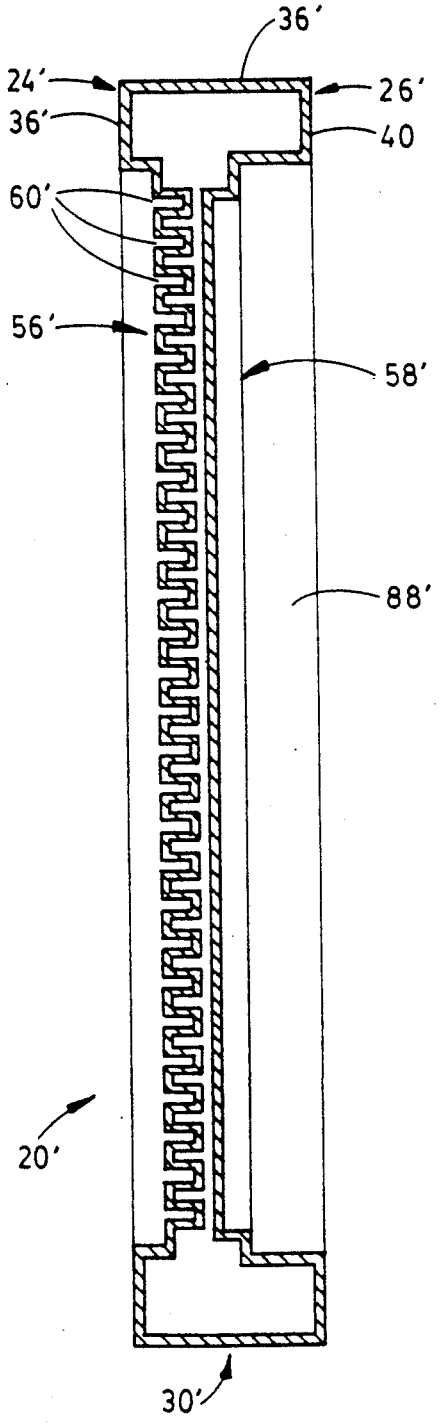
FIG. 10 is a cross-sectional view of a presently preferred embodiment of a modified sign structure in accordance with the invention.

In FIG. 10 there is shown a modified sign structure 20' which essentially is a simplified version of the sign structure 20 described above, and which is primarily useful as a letter board-type sign. This sign structure 20' differs from the sign structure 20 primarily in that it omits the shutter 78 and all of the parts in any way affiliated with the shutter 78. Because of the close relationship between these two sign structures 20 and 20', various parts of the sign structure 20' which are the same or closely related to corresponding parts of the sign structure 20 are not separately described herein. They are rather indicated in the remainder of this specification and in FIG. 10 by the primes of the numerals previously used to designate such parts.

From a consideration of FIG. 10, it will be apparent that, like the sign structure 20, the sign structure 20' has front and back sides 24' and 26' joined at a parting line 28'. These sides 24' and 26' are shaped so as to form a peripheral frame 30' including a border wall 36' carried by front and back walls 38 and 40, respectively. In the sign structure 20' the first panel 32 employed in the sign structure 20 is omitted and the panel 34' is completely surrounded by and supported by the peripheral frame 30'.

This panel 34' includes front and back walls 56' and 58', respectively. The front wall 56' directly corresponds to the previously-described wall 56 and is provided with spaced, parallel grooves or slots 60'. Grooves or furrows 88' are provided in the back wall 58' so as to reinforce and support the front wall 56'. If desired, suction cups 102' can be employed with the sign structure 110 as described in connection with the sign structure 20.

It is possible to form the sign structure 20' so that it is a comparatively thin, hollow look or to construct this sign structure 20' so that it has a distinct "solid" feel. In the latter case, the sign structure 20' can be filled with a reinforcing material 112. A preferred material for use is a known, rigid polyurethane foam. Such material is preferred because of its light weight and rigidity, and because it can be easily created within the sign structure 20'. Although such material can also be used within the sign structure 20 previously described, this is not considered to be especially desirable because of the slots 74, 76 and 80.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A changeable sign structure, said sign structure having a front side and a back side, and including a peripheral frame and first and second panels, said panels each having a front and a back surface, sides and edges, said panels having edges which are adjacent to but spaced from one another and edges which are remote from one another, said frame extending around said panels and being attached to the side edges of said panels, said sign structure including a slot separating said adjacent edges of said panels, said panels being offset with respect to one another so that the front surface of said first panel is closer adjacent to the rear of said frame than the rear surface of said second panel, said sign structure also including two parallel track means extending along said sides of said first panel adjacent to the front surface of said first panel through said slot and along said sides of said first panel adjacent to said rear surface of said second panel, said sign structure also including shutter means movably mounted in said track means, said shutter means being of such a dimension as to substantially cover said front surface of said first panel in one position and so as to expose said front surface of said panel in another position in which the improvement comprises:

said sign structure being an integral, hollow, self-supporting, thermoplastic polymer body having front and back sides which are joined at their edges, said front and back sides being spaced from one another where said sides form said peripheral frame, said front and back sides abutting against one another where said front and back sides form said first and second panels; and said track means being guide slots in said body, said guide slots extending parallel and adjacent to said front surface of said first panel and extending parallel and adjacent to said rear surface of said second panel.

2. A sign structure as claimed in claim 1 wherein:

said back side of said sign structure including spaced channels having bottoms where said front and back sides form said first panel, said bottoms of said spaced channels abutting against said front side of said sign structure, said front side of said sign structure being capable of carrying a sign where said front and back sides form said first panel;

said front side of said sign structure including spaced groove means capable of carrying interchangeable indicia where said front and back sides form said second panel, said groove means having bottoms, said bottoms of said groove means abutting against said back side of said sign.

3. A sign structure as claimed in claim 2 wherein said shutter means and said back side of said sign structure, where said front and back sides form said second panel, include cooperating latch means for holding said shutter means against movement in at least one of said positions.

4. A sign structure as claimed in claim 1 wherein:

said back side of said sign structure including spaced channels having bottoms where said front and back sides form said first panel, said bottoms of said spaced channels abutting against said front side of said sign structure, said front side of said sign structure being capable of carrying a sign where said front and back sides form said first panel;

said front side of said sign structure including spaced groove means capable of carrying interchangeable indicia where said front and back sides form said second panel, said groove means having bottoms, said bottoms of said groove means abutting against said back side of said sign structure;

said back side of said sign structure including spaced channels having bottoms where said front and back sides form said first panel, said bottoms of said spaced channels abutting against said front side of said sign structure, said front side of said sign structure being capable of carrying a sign where said front and back sides form said first panel;

said back side of said sign structure including parallel guide furrows where said front and back sides form said second panel; and said shutter means including projections fitting within said guide furrows, said guide furrows being located so as to cooperate with said projections in preventing said shutter means from being twisted during movement of said shutter means.

5. A sign structure as claimed in claim 4 whereinsaid back side of said sign structure wherein said front and back sides form said second panel and wherein said second panel and said shutter means include cooperating latch means for holding said shutter means against movement in at least one of said positions.

6. A sign structure as claimed in claim 5 wherein:

said latch means comprise a ridge on said back side of said sign structure and a bump on said shutter means, said ridge and said bump being capable of fitting against one another so as to inhibit movement of said shutter means away from said first position, said bump and said ridge being capable of being moved past one another as a result of material deformation so as to permit said shutter means to be moved from said first position to said second position; and said ridge being of such dimension as to engage such shutter means during movement of said shutter means between said positions and said bump being of such dimensions as to engage said back side of said sign structure during movement of said shutter means between said positions.

7. A changeable sign structure including a peripheral frame and first and second panels, said sign structure having opposed front and rear sides and ends, said panels each having a front and a back surface, sides and edges, said panels having edges which are adjacent to but spaced from one another and edges which are remote from one another, said frame extending around said panels and being attached to the side edges of said panels, said sign structure including a slot separating said adjacent edges of said panels, said panels being offset with respect to one another so that the front surface of said first panel is closer adjacent to the rear of said frame than the rear surface of said second panel, said sign structure also including two parallel track means extending along said sides of said first panel adjacent to the front surface of said first panel through said slot and along said sides of said first panel adjacent to said rear surface of said second panel, said sign structure also including shutter means movably mounted in said track means, said shutter means being of such a dimension as to substantially cover said front surface of said first panel in one position and so as to expose said front surface of said panel in another position in which the improvement comprises:

said sign structure being an integral, hollow, self-supporting, thermoplastic polymer body having front and back sides which ar joined at their edges, said front and back sides being spaced from one another where said sides form said frame, said front and back sides abutting against one another where said front and back sides form said first and second panels so as to reinforce said panels against distortion, said front surfaces of said panels being located on said front side and said back surfaces of said panels being located on said back side; and said track means being guide slots in said body, said guide slots extending parallel and adjacent to said front surface of said first panel and extending parallel and adjacent to said rear surface of said second panel; and said back side of said sign structure and said shutter means including cooperating latch means where said front and back sides form said second panel for holding said shutter means against movement in at least one of said positions.

* * * * *